US005613923A

United States Patent [19]

Anliker

[11] Patent Number: 5,613,923

[45] Date of Patent: Mar. 25, 1997

[54] REPETITIVE STRAIN INJURY THERAPY DEVICE

[76] Inventor: Jeff Anliker, 19740 SW. Southview, Aloha, Oreg. 97007

[21] Appl. No.: 426,285

[22] Filed: Apr. 21, 1995

[51] Int. Cl.[6] ..... A63B 21/02

[52] U.S. Cl. ..... 482/48; 482/44

[58] Field of Search ..... 84/465, 467, 468; 482/44, 47–49; 601/40

[56] References Cited

U.S. PATENT DOCUMENTS

| | | | |
|---|---|---|---|
| 248,980 | 11/1881 | Atkins | 428/48 |
| 494,197 | 3/1893 | Hall . | |
| 897,471 | 9/1908 | Loyola . | |
| 1,126,938 | 2/1915 | Barrett | 601/40 |
| 1,736,930 | 11/1929 | Marsh . | |
| 2,222,180 | 11/1940 | Marsh . | |
| 3,347,547 | 7/1965 | Hynes | 482/47 |
| 3,612,521 | 10/1971 | Wendeborn | 482/48 |
| 4,815,729 | 3/1989 | Stefanski | 482/48 |
| 4,869,499 | 9/1989 | Schiraldo | 482/124 X |
| 5,135,217 | 8/1992 | Swain | 482/48 X |
| 5,447,490 | 9/1995 | Fula et al. | 482/47 X |
| 5,514,052 | 5/1996 | Charles et al. | 482/124 X |

*Primary Examiner*—Richard J. Apley
*Assistant Examiner*—David R. Risley
*Attorney, Agent, or Firm*—Robert D. Varitz

[57] ABSTRACT

An exercise device includes an attachment mechanism which is located adjacent the fingertips and thumb tip on the user's hand. A first resilient member is attached to the attachment mechanism. An anchor mechanism is located at a fixed point relative to the user's wrist, and is attached to the first resilient member. As the user's wrist is extended, and the user's fingers and thumb are abducted, the user encounters resistance, thereby providing resistive exercise to the extensor muscles of the user's forearm.

12 Claims, 3 Drawing Sheets

REPETITIVE STRAIN INJURY THERAPY DEVICE

BACKGROUND OF THE INVENTION

The invention relates to exercise devices, and specifically to an exercise device which is useful to strengthen the extensor muscles of the lower arm, as an aid in reducing repetitive strain injury, and particularly in reducing the carpal-tunnel syndrome form of repetitive stress injury.

A moderately active individual makes thousands of different hand movements in a single day. Such activity may lead to repetitive strain injuries, such as carpal-tunnel syndrome, in which the tendons and ligaments in the carpal tunnel swell and compress nerves, resulting in hand numbness. A similar disease is known as De Quervan's disease, which cause localized numbness in the thumb, thereby preventing thumb movement. Swelling of the tendons in the carpal tunnel may also reduce circulation to the hands, further causing numbness and pain.

Carpal-tunnel syndrome, also referred to as CTS, may be caused or aggravated by a variety of disorders, such as arthritis or pregnancy, or by drugs which cause the body to retain fluids. Additionally, individuals who spend extended periods of time with their wrist in a flexed condition may develop CTS. One cause of CTS is the continuous flexing of the wrist which is particularly common amongst individuals who spend long periods of time at keyboards, whether such keyboards be associated with computers per se, or with cash registers or other such devices. Such flexing is generally accompanied by pronation of the hand, i.e., holding the palm in a downward facing position, which further strains the connective tissue and nerves running through the carpal tunnel. Musicians are also subject to CTS, as are individuals who do a great deal of lifting. It is common in such individuals that the flexor muscles of the forearm are much stronger than the extensor muscles of the forearm, which tend to leave the wrist in a flexed condition, even when it is not necessary for the wrist to be flexed. CTS itself is caused by compression of the median nerve, which runs through the wrist and branches into the palm, thumb and first three fingers. The median nerve runs through a bony structure which is identified as the carpal tunnel. The flexor tendons and the carpal ligament in the carpal tunnel may swell due to repetitive hand movements, pinching the medial nerve and producing the condition known as CTS. CTS generally results in an inability effectively to grip with the hands, and is usually accompanied by a tingling and numbness in the fingers.

In some instances, a mild case of CTS may be mitigated by resting the wrist, or by varying its movement throughout the day. Anti-inflammatory drugs or cortisone may be given to reduce swelling. In some instances, surgery is performed to lessen CTS, however, it is very possible that the surgery may produce further swelling in the carpal tunnel, and ultimately, may aggravate the condition rather than curing it.

Repetitive Strain Injury (RSI) may occur in any part of the body. When it occurs in the hands, it can produce severe pain in the wrist and forearm, and result in reduced gripping ability in the hand.

Known exercises, such as wrist extensions, still require the flexion of the fingers to grip a weight, and do not provide resistance to the abductor or extensor muscles of the fingers. Other devices, such as the Tiger Paw™, provide limited resistance for the abductor muscles, but do nothing to strengthen the extensor muscles that extend the hand at the wrist.

The exercise device of the invention is intended to strengthen the extensor muscles of the fingers, hand and wrist located in the forearm and the abductor muscles of the fingers, thereby providing a balance between the extensor and flexor muscles to prevent the continuous flexing of the wrist, thereby eliminating one of the causes of CTS.

Summary of the Invention

The exercise device of the invention includes an attachment mechanism which is located adjacent the fingertips and thumb tip on the user's hand. A first resilient member has a spaced-apart, opposed ends and is attached to the attachment mechanism. An anchor mechanism is located at a fixed point relative to the user's wrist, and is attached to the first resilient member. As the user's wrist is extended, and the user's fingers and thumb are abducted, the user encounters resistance, thereby providing resistive exercise to the extensor muscles of the user's forearm.

An object of the invention is to provide an exercise device which will exercise the extensor muscles of the user's forearm.

Another object of the invention is to provide an exercise device which will exercise the abductor muscles of a user's fingers.

Still another object of the invention is to provide such an exercise device which is quite portable.

A further object of the invention is to provide an exercise device which is easy to use, inexpensive to manufacture and durable.

These and other objects and advantages of the invention will become more fully apparent as the description which follow is read in conjunction with the drawings.

BEST MODE OF PRACTICING THE INVENTION

Figures 1, 5, 6:
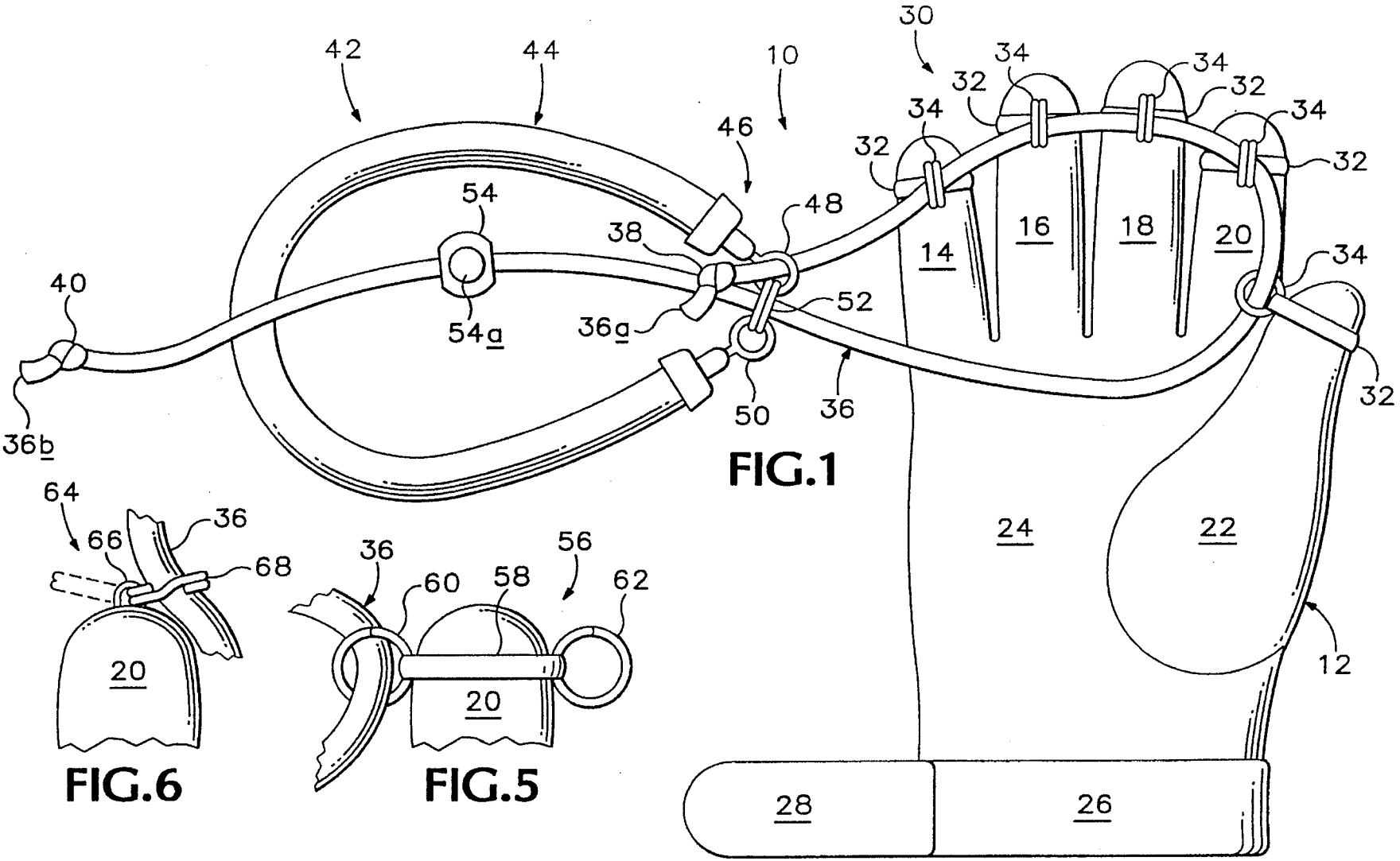
FIG. 1 is plan view the preferred embodiment of the invention.
FIG. 5 depicts a first alternate embodiment of an attachment mechanism of the invention.
FIG. 6 depicts a second alternate embodiment of the attachment mechanism of the invention.

Turning initially to FIG. 1, the exercise device of the invention is depicted generally at 10. In the preferred embodiment, device 10 includes a glove 12 which is worn on a user's hand. Glove 12 includes the usual finger elements 14, 16, 18, and 20, a thumb element 22, a glove body 24, and a wrist strap 26, which includes a hook-and-loop closure strap 28. Glove 10 may be a modified exercise glove having full finger elements.

An attachment mechanism, depicted generally at 30 is located adjacent the fingertips of a user's hand and, in the preferred embodiment, includes a band 32 and a ring, or loop, 34. In the depicted embodiment, the band is attached to the fingers of the gloves, although any form of attachment mechanism which may be located adjacent the fingertips and thumb tip of a user may be provided. The finger elements may be reinforced adjacent their tips, so as to provide additional support for loop 34, which may allow construction of the invention without the need for band 32. As depicted in FIG. 1, loops 34 face the anterior, or palm side, of the user's hand.

A first resilient member 36 is provide and is trained through rings 34 of attachment mechanism 30. First resilient member 36 has spaced-apart, opposed ends, such as ends 36*a* and 36*b*. In the preferred embodiment, resilient member 36 is formed of a length of surgical tubing, and the ends are provided with keeper knots 38, 40. Resilient member 36 has a first modulus of elasticity, which will be further described later herein.

An anchor mechanism 42 is attached to first resilient member 36. In the preferred embodiment, anchor mechanism 42 includes a second resilient member 44, having a second modulus of elasticity, which is used to provide an anchor point for the exercise device, and a retainer mechanism 46. Retainer mechanism 46 includes a first retaining ring 48, a second retaining ring 50 and a third retaining ring 52. Third retaining ring 52 joins first and second retaining rings 48 and 50. One end 36*a* of first resilient member 36 is captured by first retaining ring 48 while an intermediate portion of first resilient member 36 is passed through third retaining ring 52. An adjustment mechanism 54 is provided along the length of first resilient member 36 and is operable to adjust the length of first resilient member 36 relative to retaining mechanism 46. Adjustment mechanism 54, in the preferred embodiment, takes the form of a bead having a pair of bores extending normal to one another therethrough. A spring-biased clamp 54*a* is located in one of the bores and first resilient member 36 extends through the other bore.

Figure 2:
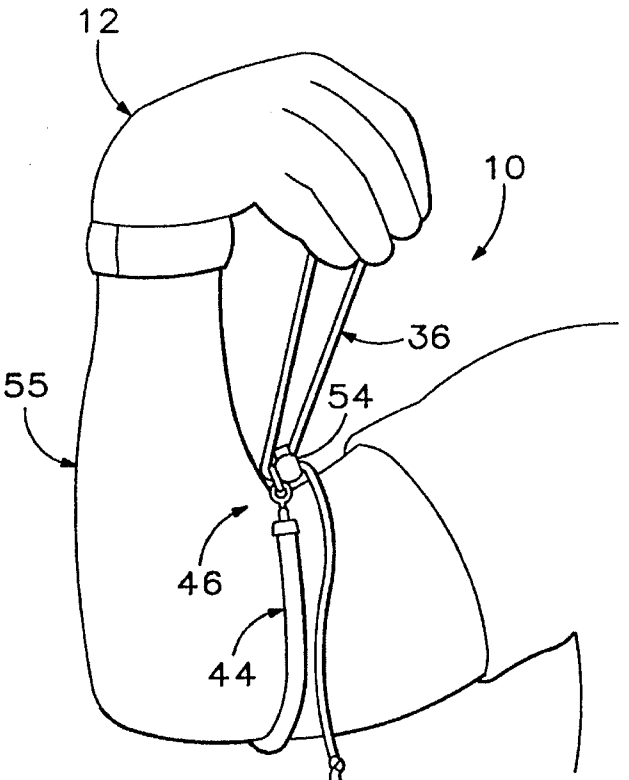
FIGS. 2–4 represent environmental views of the exercise device of the invention, in progressive stages of exercises performed therewith.
Figure 3:
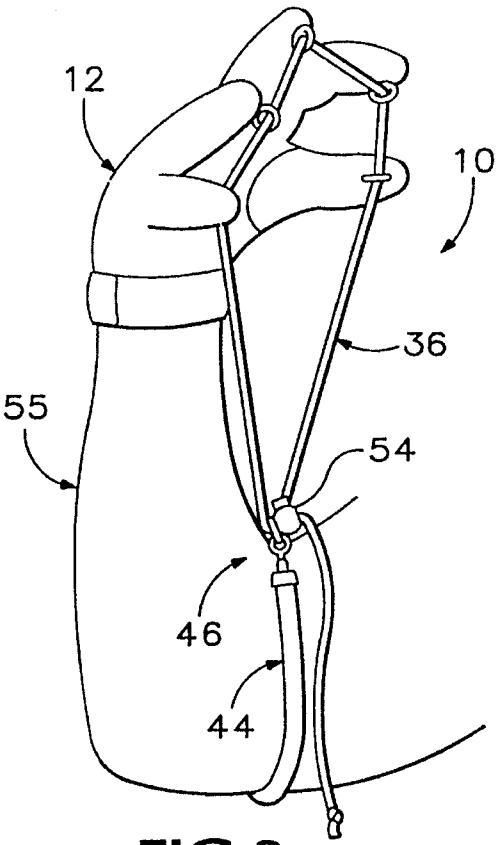
Figure 4:
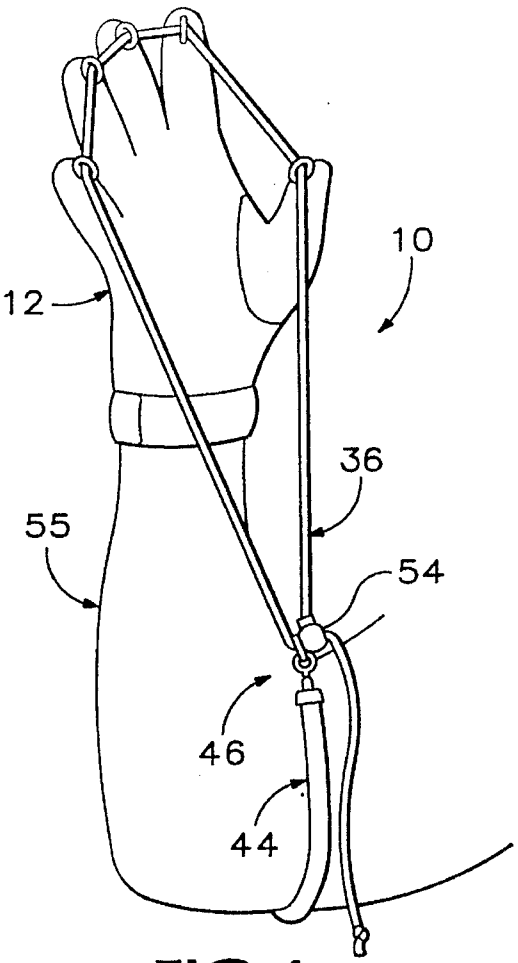

Referring now to FIGS. 2–4, device 10 is depicted in place on a user's arm 55, and it is shown during progressive stages of the exercise. As shown in FIG. 2, glove 12 is worn on a user's hand while second resilient member 44 is attached about the user's upper arm, between the elbow and shoulder. First resilient member 36 is adjusted by means of adjustment mechanism 54, which releasably captures a portion of resilient member 36, to provide a desired amount of resistance.

As shown in FIG. 3, the user begins the exercise by extending the user's hand while simultaneously abducting (spreading) the fingers and thumb. As depicted in FIG. 4, the wrist is completely straightened and the fingers are fully spread, thereby completing the positive portion of the exercise. The user allows the wrist to flex and the fingers and thumb to adduct to perform the negative portion of the exercise.

As the user extends the user's wrist and abducts the user's fingers, the *abductor pollicis longus* abducts and extends the thumb, along with the *extensor pollicis longus* and the *extensor pollicis brevis*. The *extensor digitorum* works to extend all of the joints of the fingers, as well as extending the wrist, while the *extensor indicis* and *extensor digiti minimi* extend the index and little fingers, respectively. The *extensor carpi radialis brevis*, the *extensor carpi radialis longus* and the *extensor carpi ulnaris* all work together to extend the wrist.

As shown in FIGS. 2–4, first resilient member 36 provides resistance to both the extension of the hand at the wrist and to the abduction of the fingers and thumb. While a certain amount of movement of rings 34 along first resilient member 36 is allowed by the device, the combination of extending the wrist and abducting the fingers and thumb works all of the extensor muscles of the user's forearm. By strengthening the extensor muscles, those individuals who are subject to carpal tunnel syndrome may achieve a balance in the strength between the extensor and flexor muscles of the arm, thereby alleviating the symptoms of the syndrome, which is believed to be caused by an imbalance in muscle strength wherein the flexor muscles are much stronger than the extensor muscles, and which results in the constant flexing of the wrist and adduction of the fingers. The exercise is performed with the hand supinated, to also provide resistance to the rotator muscles of the arms. With the hand held in the position shown in FIGS. 2–4, the *supinator brevis* and the *supinator longus*are both exercised.

As previously noted, first resilient member 36 has a first modulus of elasticity, while second resilient member 44 has a second modulus of elasticity. In the preferred embodiment, the first modulus of elasticity is greater than that of the second modulus of elasticity, thereby allowing greater relative stretching of first resilient member 36 than of second resilient member 44. Second resilient member 44, in the preferred embodiment, has sufficient stretch to allow the user comfortably to position the member on the user's arm, but does not allow significant stretching of the second resilient member during the exercise so that most of the resistance to the exercise is provided by first resilient member 36. Alternate embodiments of the invention may include a non-resilient strap in place of second resilient member 44, however, for ease of construction, anchor mechanism 42 includes an elastic second resilient member. It is also conceivable that the first resilient member could be anchored to a fixed point, such as a tabletop, wherein the exercise device would not be attached to the user's upper arm.

As described so far, glove 12 is shown on a user's right hand. In the preferred embodiment of the invention, a similar glove is provided for the left hand so that both arms simultaneously may be exercised. Alternately, the attachment mechanism of the invention may be modified as depicted generally at 56 in FIG. 5. Attachment mechanism 56 is depicted on a finger element 20, and includes a band 58, having rings or loops 60, 62 on either side thereof. In this embodiment, a device similar to adjustment mechanism 54 is provided in place of keeper knot 38, which will allow one end of first resilient member 36 to be removed from first retaining ring 48 and rings 60 of attachment mechanism 56, and reinstalled through rings 62, thereby allowing use of the exercise device on the other hand.

Another embodiment of the attachment mechanism is depicted generally at 64 in FIG. 6. In this embodiment, the attachment mechanism includes a retaining loop, or attachment point, 66, which is attached to the tip of the finger and thumb elements of the glove, such as finger element 20, and includes a ring or loop 68 which receives first resilient member 36 therethrough. In this embodiment, the user simply removes the glove from one hand and places it on the other, and shifts the position of first resilient member 36 for the proper hand. Other embodiments of the attachment device may be provided.

It will be apparent to those of skill in the art that the embodiments depicted in FIGS. 5 and 6 are used with the loops of the attachment mechanism facing, or directed towards, the anterior, or palm, side of the user's hand.

Figure 8:
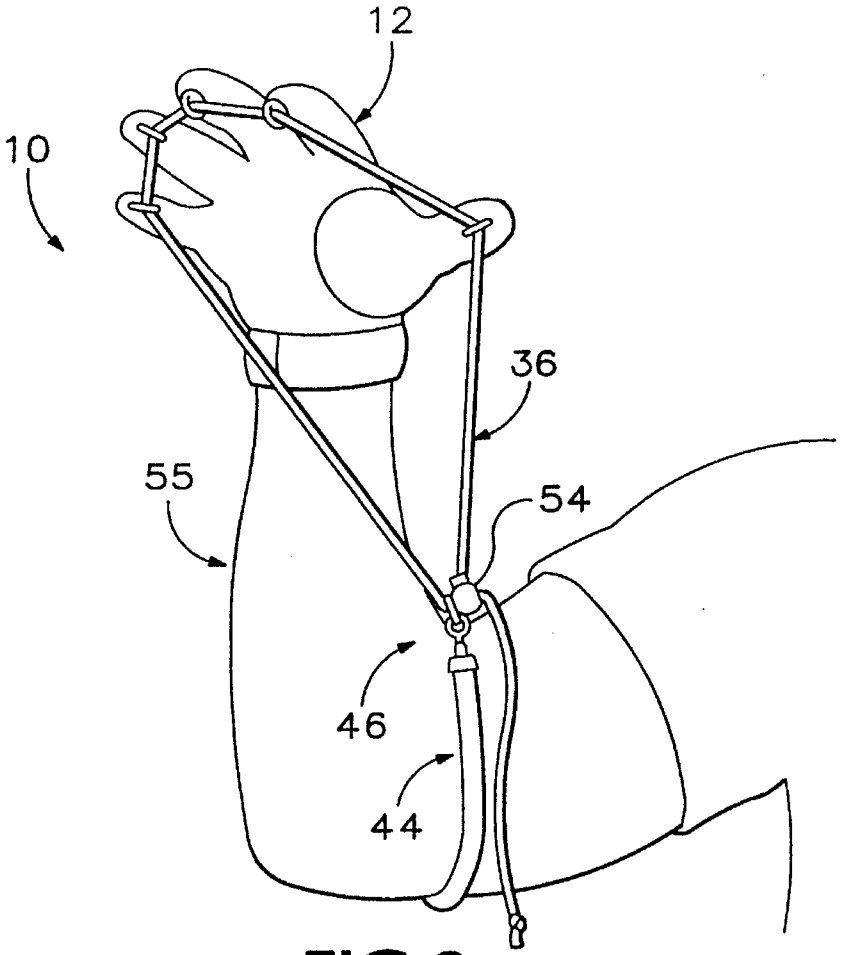
FIGS. 7 and 8 are progressive environmental views of a additional exercise techniques using the invention.
Figure 7:
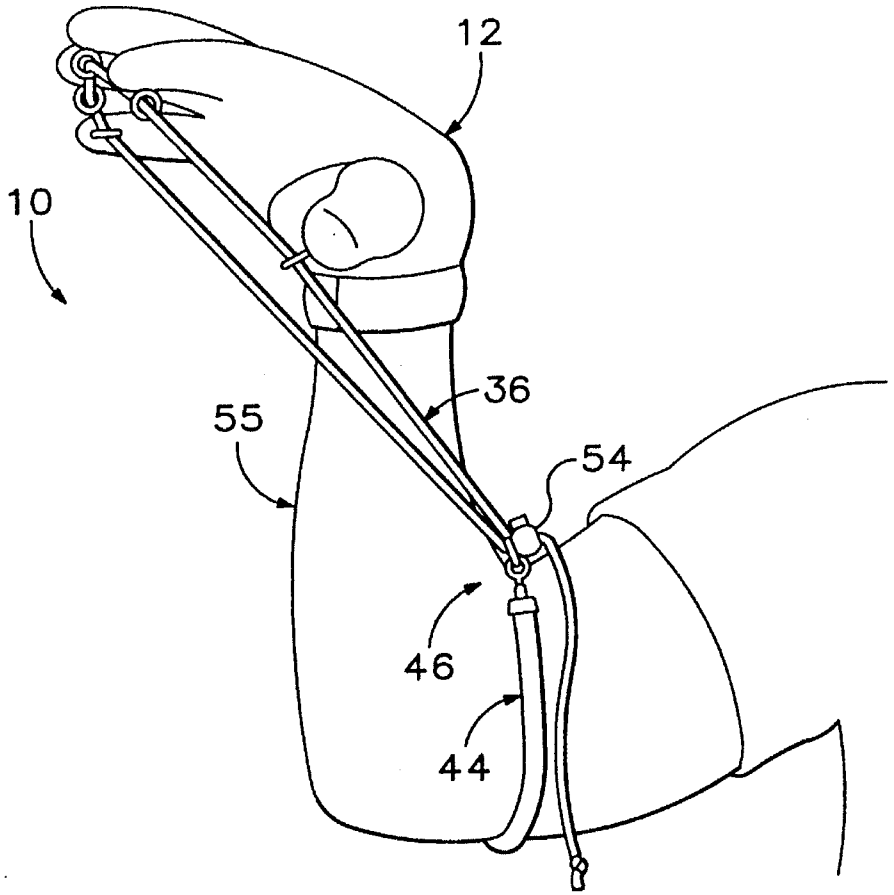

Referring now to FIGS. 7 and 8, further variations in the manner of exercising with exercise device 10 are depicted. In FIG. 7, the user's hand is aligned parallel with the user's upper arm. Exercising with the device as previously described in this position provides a certain amount of exercise for the bicep muscle of the upper arm and for the rotator muscles of the forearm.

In the form of exercise depicted in FIG. 8, the hand is held at 90 degrees to the upper arm, thereby providing exercise for the rotator muscles of the lower arm.

Although a preferred embodiment of the invention has been described, along with several variations thereto, it should be appreciated that further modifications and variations may be made to the device of the invention without departing from the scope of the invention as defined in the appended claims.

I claim:

1. An exercise device for strengthening finger, hand, wrist and forearm muscles comprising:

an attachment mechanism located adjacent the finger tips and thumb tip of the anterior surface of a user's hand, wherein said attachment mechanism includes a plurality of bands constructed and arranged to encircle each of the user's fingers and thumb, and which further includes a plurality of loops, wherein each of said loops is affixed to one of said bands;

a first resilient member which is elastic and which is attached to said attachment mechanism, and which biases the user's fingers and thumb to a flexed, adducted condition, and wherein said first resilient member is trained through each of said loops on said attachment mechanism;

an anchor mechanism located at a fixed point relative to the user's wrist and attached to said first resilient member, and which biases the user's wrist to a flexed condition;

wherein, as the user's fingers and thumb are wrist are extended and the user's fingers and abducted, the user encounters resistance thereby exercising the extensor muscles of the user's fingers, hand, and wrist and the abductor muscles of the user's fingers and thumb.

2. The device of claim 1 wherein said anchor mechanism includes a second resilient member which is trained about the user's upper arm.

3. The device of claim 2 wherein said first resilient member has a first modulus of elasticity and said second resilient member has a second modulus of elasticity, and wherein said first modulus of elasticity is greater than said second modulus of elasticity.

4. The device of claim 1 wherein said attachment mechanism includes plural loops on each band, wherein said first resilient member is trained through each of said loops on the anterior surface of a user's hand when the exercise devise is in use.

5. The device of claim 1 wherein said first resilient member includes an adjustment mechanism for adjusting the resistance produced thereby, said adjustment mechanism being operable to change the length of said first resilient member.

6. The device of claim 1 wherein said first resilient member includes a first portion trained through said attachment mechanism and another portion thereof extending along the length of the user's forearm towards the user's elbow, and wherein said anchor mechanism includes a second resilient member which is attached to said other portion.

7. The device of claim 1 wherein said attachment mechanism is carried on a glove.

8. An exercise device for strengthening finger, hand, wrist and forearm muscles comprising:

a glove worn on a user's hand;

an attachment mechanism located on the palm side of said glove adjacent the finger tips and thumb tip of said glove, including a plurality of bands constructed and arranged to encircle each of the user's fingers and thumb, and further including a plurality of loops wherein each of said loops is affixed to one of said band;

a first resilient member which is elastic and which is attached to said attachment mechanism, wherein said first resilient member is trained through each of said loops on said attachment mechanism;

a second resilient member which is elastic and which is attached to said first resilient member and which is trained about the user's arm adjacent the user's elbow;

wherein, as the user's fingers and wrist are extended and the user's fingers and thumb are abducted, the user encounters resistance thereby exercising the extensor muscles of the user's fingers, hand, wrist and elbow and the abductor muscles of the user's fingers and thumb.

9. The device of claim 8 wherein said first resilient member has a first modulus of elasticity and said second resilient member has a second modulus of elasticity, and wherein said first modulus of elasticity is greater than said second modulus of elasticity.

10. The device of claim 8 wherein said attachment mechanism includes plural loops on each band, wherein said first resilient member is trained through each of said loops on the palm side of a user's hand when the exercise device is in use.

11. The device of claim 8 wherein said first resilient member includes an adjustment mechanism for adjusting the resistance produced thereby, said adjustment mechanism being operable to change the length of said first resilient member.

12. An exercise device for strengthening finger, hand, wrist and forearm muscles comprising:

a glove worn on a user's hand;

a plurality of bands on said glove constructed and arranged to encircle each of the user's fingers and thumb;

attachment loops located on the palm side of said glove adjacent the finger tips and thumb tip of said glove, wherein each of said attachment loops is affixed to one of said bands;

a first resilient member, having a first modulus of elasticity, which is trained through each of said attachment loops and which includes an adjustment mechanism for adjusting the resistance produced thereby;

a second resilient member, having a second modulus of elasticity, which is attached to said first resilient member and which is trained about the user's upper arm adjacent the user's elbow, wherein said first modulus of elasticity is greater than said second modulus of elasticity;

wherein, as the user's fingers and wrist is extended and the user's fingers and thumb are abducted, the user encounters resistance thereby exercising the extensor muscles of the user's fingers, hand, wrist and elbow and the abductor muscles of the user's fingers and thumb.

* * * * *